United States Patent [19]

Corona et al.

[11] 4,329,622

[45] May 11, 1982

[54] LOW PRESSURE GAS DISCHARGE LAMP WITH INCREASED END ILLUMINATION

[75] Inventors: Stephen C. Corona; Karl A. Northrup, both of Rochester, N.Y.

[73] Assignee: Xerox Corporation, Stamford, Conn.

[21] Appl. No.: 151,012

[22] Filed: May 19, 1980

[51] Int. Cl.[3] ..... H05B 35/00; H01J 61/96

[52] U.S. Cl. ..... 315/49; 313/488; 313/492; 313/216; 315/67; 315/98; 315/105; 315/DIG. 1

[58] Field of Search ..... 315/49, 64, 66, 67, 315/94, 98, 105, DIG. 1; 313/8, 488, 492, 188, 216, 307, 491; 355/69; 362/211

[56] References Cited

U.S. PATENT DOCUMENTS

| | | | |
|---|---|---|---|
| 1,814,499 | 7/1931 | Von Wedel | 315/98 |
| 2,605,432 | 7/1952 | Smith | 313/38 |
| 2,654,042 | 9/1953 | Clarke et al. | 313/485 |
| 3,089,972 | 5/1963 | Larson et al. | 313/34 |
| 3,458,757 | 3/1967 | Dubs | 315/99 |
| 3,521,122 | 7/1970 | Peek, Jr. | 313/216 X |
| 3,717,781 | 2/1973 | Sadoski et al. | 313/220 X |
| 3,733,599 | 5/1973 | Fantozzi | 315/241 R X |
| 3,851,209 | 11/1974 | Murakami et al. | 315/99 |
| 3,882,349 | 5/1975 | Holz et al. | 313/519 |
| 4,051,407 | 9/1977 | Van der Werf et al. | 315/106 |
| 4,140,385 | 2/1979 | Shaw et al. | 355/67 X |
| 4,155,758 | 5/1979 | Evans et al. | 75/232 |

*Primary Examiner*—Eugene R. La Roche

[57] ABSTRACT

A low pressure gas discharge lamp is provided with a pair of high power incandescent electrodes to increase output illumination at the lamp ends. In an alternate construction, the electrodes are of high power, low emissivity and are electrically connected to a second pair of high emissivity electrodes which provide the means for enabling the mercury discharge. With this second construction, the low emissivity electrodes can act as ballast for the circuit.

4 Claims, 7 Drawing Figures

LOW PRESSURE GAS DISCHARGE LAMP WITH INCREASED END ILLUMINATION

BACKGROUND OF THE INVENTION

This invention relates to low pressure gas discharge lamps and, particularly, to an apertured fluorescent lamp of the type used to provide a uniform distribution of illumination along a surface.

Tubular low pressure arc discharge lamps, such as conventional fluorescent and sodium vapor lamps, project light upon a surface in a relatively uniform manner except for a gradual decrease in illumination near the ends. This end falloff is ordinarily not a problem when the lamp is used for general purpose lighting. In certain applications, however, such as use as the exposure source in a photocopying machine, the light falloff must be compensated for in some manner since relatively uniform illumination of the entire width of a document to be copied must be obtained. Various ways of providing for this compensation are known to the art: U.S. Pat. Nos. 3,225,241 and 3,717,781 are representative of the so-called aperture fluorescent lamps which disclose ways of charging the properties of the coatings near the ends of the lamp. In the xerographic art, it is more usual to shape the output light profile of the scanning lamp by interposing a so-called butterfly slit between the lamp and the document, the slit shape serving to allow increased illumination at the ends of the document. Alternatively, the longitudinal dimensions of the lamp are increased so that only the central portion of the lamp which provides relatively uniform illumination is utilized.

It is a principal object of this invention to provide an apertured gas discharge lamp which provides relatively uniform illumination along the entire length of the aperture.

It is a further object to provide an aperture lamp of reduced length which nonetheless provides uniform illumination along the length of the aperture.

SUMMARY OF THE INVENTION

According to the present invention, an apertured low pressure gas discharge lamp utilizes end filaments which are of relatively high power and of high color temperature. These filaments contribute to the light output at the tube ends which compensates for the illumination falloff.

DRAWINGS

Figure 4A:
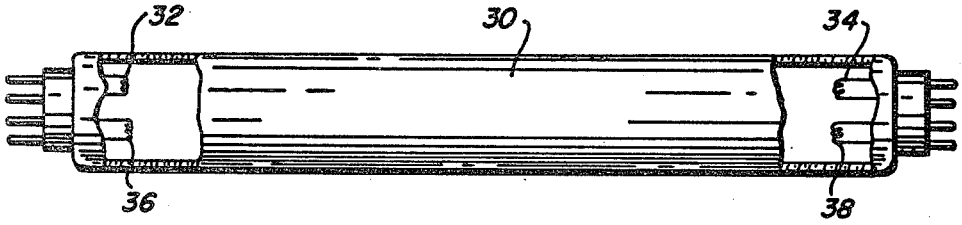

FIG. 4*a* shows a fluorescent lamp with a first alternate electrode construction utilizing pairs of auxiliary high emissivity electrodes.

Figure 4B:
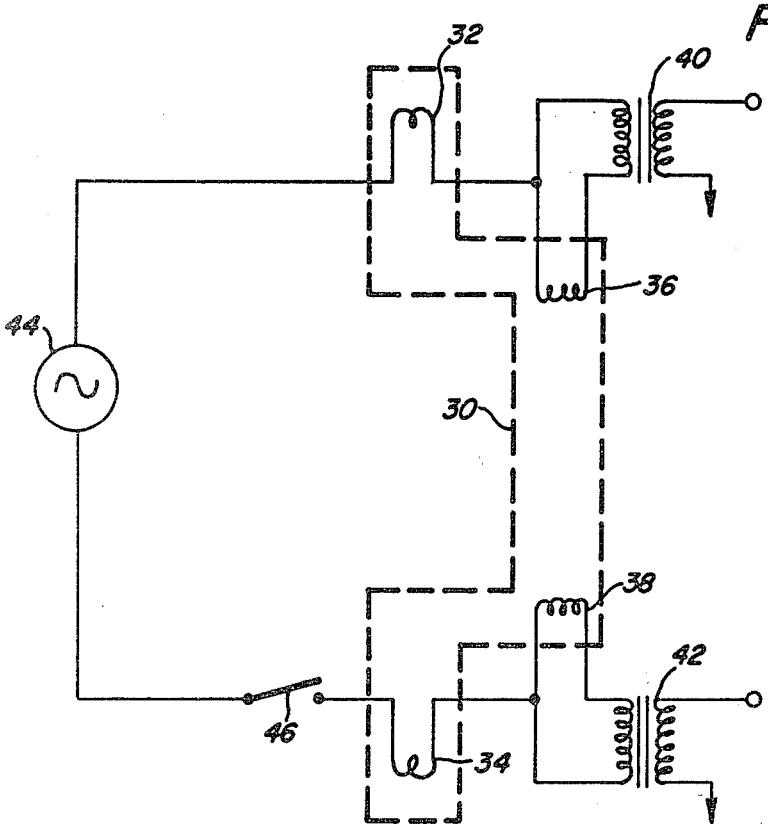

FIG. 4*b* is a circuit utilizing the lamp shown in FIG. 4*a*.

Figure 5A:
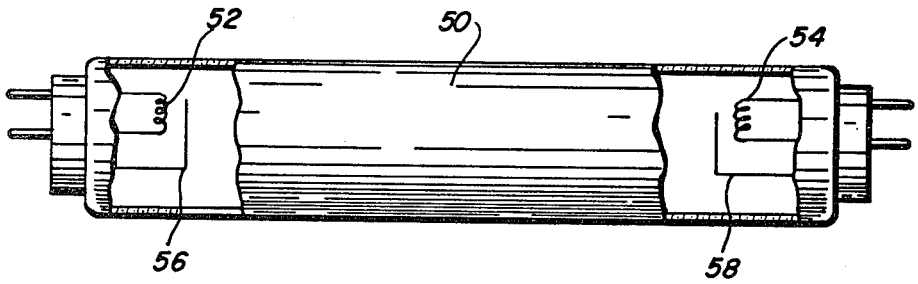

FIG. 5*a* shows a fluorescent lamp with a second electrode construction utilizing pairs of auxiliary high emissivity electrodes.

Figure 5B:
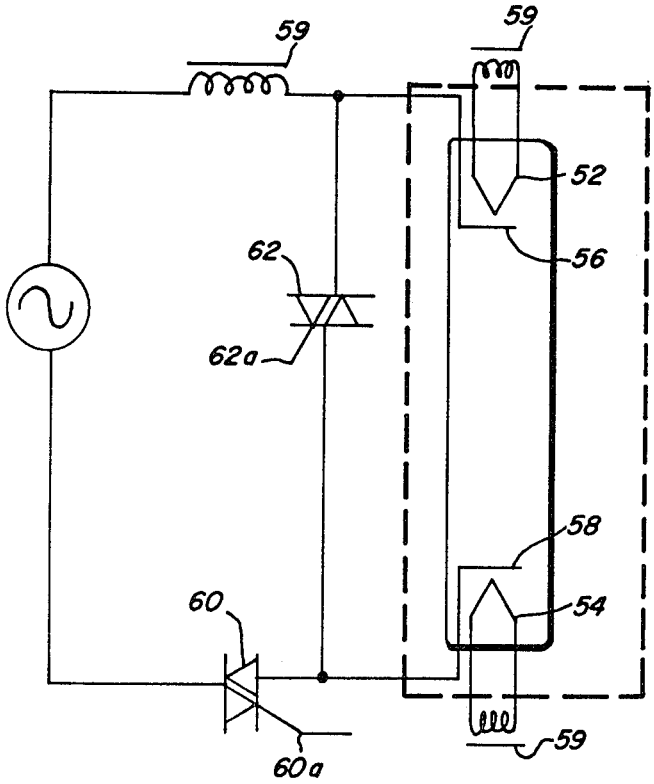

FIG. 5*b* is a circuit utilizing the lamp shown in FIG. 5*a*.

DESCRIPTION

Figure 1:
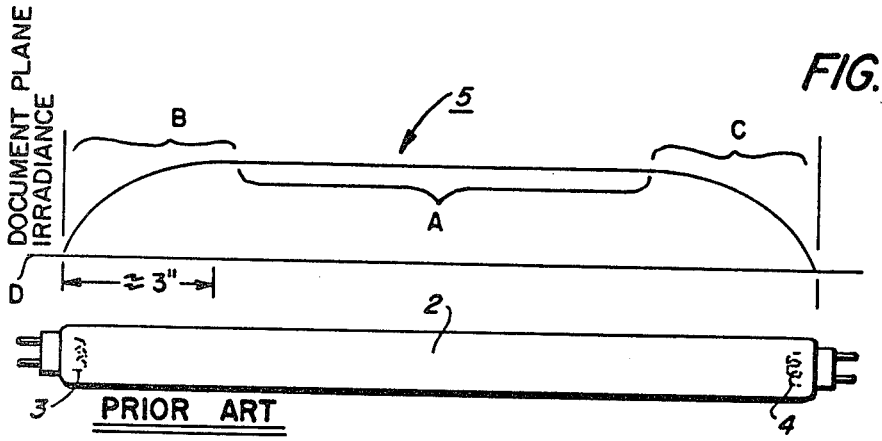
FIG. 1 shows a prior art fluorescent lamp with a non-uniform irradiance profile at a document plane.

Although the inventive features of the present invention are applicable to any low pressure gas discharge lamp, the following description is related to fluorescent-type lamps. Commercial fluorescent lamps are basically low pressure mercury discharge lamps designed to emit a maximum portion of their energy in the 2537 Å line of the mercury spectrum. This short wave ultraviolet energy is converted by the phosphor coating the insides of the tubes into visible light. FIG. 1 shows a prior art fluorescent lamp with its typical document irradiance profile. As shown, lamp 2 has high emissivity incandescent filaments 3,4, i.e. the filaments have a high ability to emit or give off electrons. The oxide coated filaments typically are of low power (approximately 4 watts) which are heated to a low color temperature of approximately 1350° K. before arc discharge. When energized, the lamp provides a document illumination output profile 5 at a plane D parallel to the axis of the lamp. The profile is fairly uniform over a central portion A but falls off over end portions B and C due to the finite length of the arc. If uniform illumination of a surface is required, as for example, in the illumination of a document to be copied in a photocopying application, several limited options have heretofore been available. In one solution only the central portion A of the lamp output is used in an apertured configuration extending the length of the lamp until portion A is long enough to illuminate the required surface length. Another solution is to compensate for the light falloff by shaping the lamp aperture to allow more light to emerge from the end portions. Still another method is to attenuate the central portions of the illumination profile by use of a "butterfly" slit in the optical path of the photocopies. This solution requires added lamp power to maintain sufficient exposure.

According to the principles of the present invention, the filaments 3,4 are energized to a color temperature and power level sufficiently high to contribute an additional component of light which compensates for the illumination falloff at end portions B and C.

Figure 2:
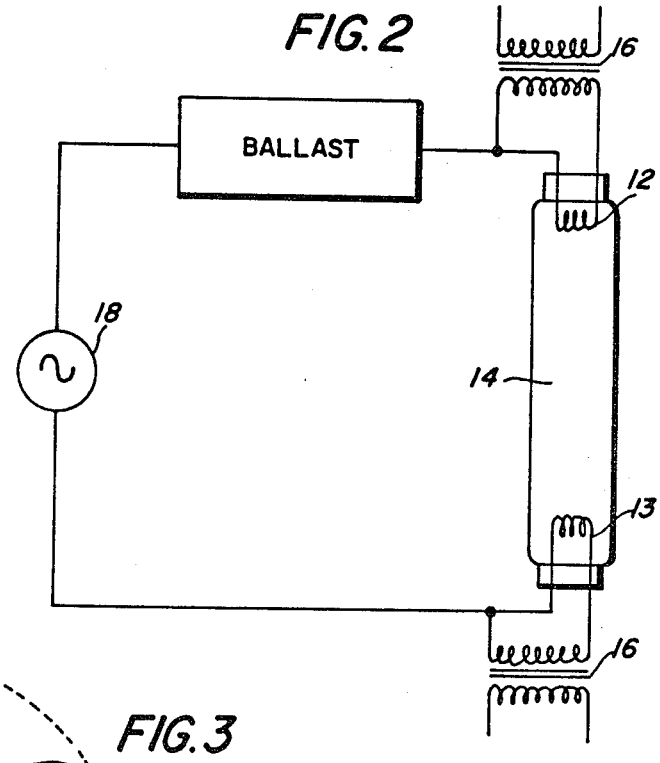
FIG. 2 shows a fluorescent lamp utilizing high power filaments, the power being supplied by an isolation transformer.
Figure 3:
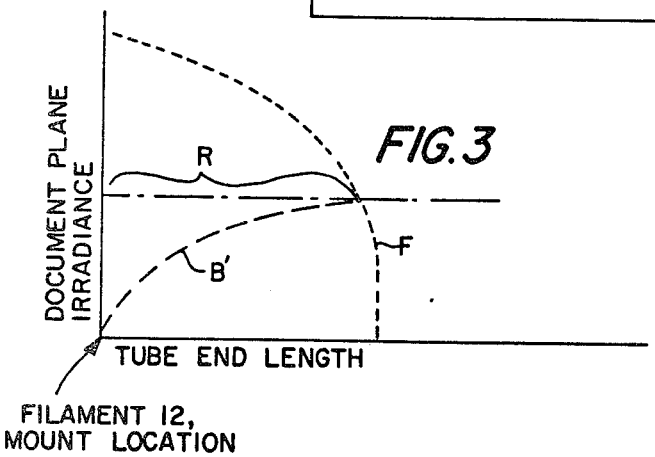
FIG. 3 is a plot of tube length vs. document plane irradiance for the lamp shown in FIG. 2.

FIG. 2 shows a circuit wherein tungsten filaments 12,13 of lamp 14 are operated at approximately 3000° K. Transformer 16 connected to a power source (not shown) supplies an isolated current to filaments 12 and 13. The lamp is operated from ac source 18 which supplies current sufficient to cause a discharge between filaments 12,13. Ballast 20 is a positive impedance device connected between the lamp and source 18 to provide the required current limiting. As one example of possible operating parameters, transformer 16 provides 40 watts each to filaments 12,13 causing them to incandesce to a color temperature of approximately 3000° K. FIG. 3 demonstrates the compensation to one end of the tube resulting from the increased light contribution of the end filament. Portion B′ represents the inherent illumination falloff at the lamp's end; portion F represents the contribution to light output by the high brightness filament 12 and portion r represents the resultant increase in illumination level. It is, of course, understood that other operating parameters are possible consistent with the principles of the invention; i.e. so long as increased light output of the filaments is achieved.

FIGS. 4 and 5 provide alternate configurations of the invention wherein one set of filaments of high power and low emissivity provide increased end illumination. The second set of filaments are constructed of high emissivity electrodes and are incorporated within the lamp to facilitate normal mercury discharge. The high power, low emissivity filaments, according to another feature of the present invention, can be utilized as the ballast for the circuit.

Referring now to FIGS. 4A, 4B, lamp 30 has a pair of high power, low emissivity filaments 32, 34 and high emissivity filaments 36,38. Transformers 40,42 connected to a power source (not shown) supply a preheat voltage to filaments 36, 38. Upon the closing of switch 46, power is applied to the lamp electrodes. In operation, filaments 36, 38 in lamp 30 act in the manner of a standard fluorescent lamp, while filaments 32, 34 provide the additional light necessary to compensate for the end falloff of the aerial illumination profile. Filaments 32, 34 can also ballast the fluorescent portion of lamp 30, if the filaments are electrically isolated from filaments 36, 38 and from the mercury arc discharge. This can be accomplished using known transformer isolation techniques. Alternatively, filaments 32, 34 can also be isolated by mounting each filament within a glass envelope.

Typical operating parameters for this embodiment are:

Line voltage—120/240 ac

Transformers 40,42—standard filament transformers with dual isolated outputs at 3.8 VAC, 1.1 amps each Filaments 36, 38 color temperature—1350° K.

Filaments 32, 34 color temperature—3000° K.

Filaments 32, 34 material—tungsten

Filaments 36, 38 material—oxide coated tungsten (barium, strontium are suitable materials)

Referring now to FIGS. 5A, 5B, lamp 50 has a pair of high power, low emissivity filaments 52,54 and a pair of high emissivity electrodes 56,58. Filaments 52,54 are constructed of a low emission material which does not release electrons as effectively as electrodes 56,58 which are constructed of high emission materials. Heat produced by filaments 52,54 indirectly heats electrodes 56 and 58, respectively, causing them to become effective emitters. Transformer 59 provides electrical isolation for filaments 52, 54.

Triacs 60,62 are bilaterial semiconductor switches which, when gated, permit current conduction in the direction indicated by the forward bias of the semiconductor. As will be understood, other types of bilateral switching currents may be used in place of triacs 60,62. In operation, and with discharge lamp 50 being off, a voltage is applied to gate 60*a* and 62*a* causing switches 60 and 62 to conduct and apply an initial preheat voltage to filaments 56,58 causing the filaments to heat up.

When electrodes 56,58 are sufficiently heated to approximately 1350° K., triac 62 is turned off, causing a sufficient voltage drop across electrodes 56 and 58 to initiate a mercury discharge. Once started, the arc discharge is "self-sustaining". Since filaments 52 and 54 emit few electrons, they provide a portion of the necessary ballast by contributing their resistance to the primary of transformer 59 which is in series with the main discharge path of the mercury arc.

With all of the above embodiments, it is obvious that the end portion of the lamp segments B and C of FIG. 1 can be made to produce illumination which is uniform with the central (A) portion of the lamp. It is thus not necessary to lengthen the tube length to achieve the required illumination uniformity thus permitting a more compact illumination system to be used.

What is claimed is:

1. A low pressure arc discharge lamp having internal ballasting comprising:

an elongated light transmissive envelope containing an ionizable medium therein, a source of AC line voltage, a first pair of electrodes sealed into the opposite ends of said envelope and electrically connected to said voltage source, said electrodes constructed of a material having high power and low emissivity, a second pair of electrodes sealed into the opposite ends of said tube and electrically connected to said voltage source, said second electrode pair constructed of a material having high emissivity and means for electrically isolating said first and second electrode pairs, wherein upon application of said line voltage an ionization discharge of said medium occurs with said first electrode pair providing the necessary impedance to limit lamp operating current while simultaneously providing additional illumination to compensate for illumination falloff at the ends of the lamp.

2. The lamp as claimed in claim 1 wherein said isolation means comprises a glass envelope surrounding and sealing said first electrode pair.

3. A low pressure arc discharge lamp comprising:

an elongated light transmissive envelope containing an ionizable medium therein, a first pair of electrodes sealed into the opposite ends of said envelope, said electrodes constructed of a material having high power and low emissivity, and a second pair of electrodes sealed into said opposite ends of said envelope and electrically isolated from said first electrode pair, said second pair of electrodes having high emissivity characteristics.

4. A self-ballasting low pressure arc discharge lamp comprising:

an elongated light transmissive envelope containing an ionizable medium therein, a source of AC line voltage, a first pair of high power low emissivity electrodes sealed into the opposite ends of said envelope, a second pair of high emissivity electrodes located in close proximity to said first electrode pair and connected to said AC line voltage, a transformer connected between said AC line source and said lamp electrodes, the secondary winding of said transformer connected to said first electrode pair, gating means for applying a preheat voltage to said first electrode pair and for initiating ionization of said medium, said first electrode pair, during arc discharge, forming, with said transformer, part of the system ballasting, while simultaneously heating said second electrode pair to a higher brightness level.

* * * * *